US005101738A

United States Patent [19]

Sideris

[11] Patent Number: 5,101,738

[45] Date of Patent: Apr. 7, 1992

[54] REVOLVING BOOKCASE

[76] Inventor: Xen N. Sideris, 666 Georgia Ave., Palo Alto, Calif. 94306

[21] Appl. No.: 614,305

[22] Filed: Nov. 16, 1990

[51] Int. Cl.[5] ..... A47B 57/00

[52] U.S. Cl. ..... 108/94; 211/163; 211/144

[58] Field of Search ..... 108/92, 94; 211/144, 211/163, 42, 43, 77; 312/135, 305

[56] References Cited

U.S. PATENT DOCUMENTS

| | | | |
|---|---|---|---|
| 18,102 | 8/1857 | Farrar et al. . | |
| 111,608 | 2/1871 | Castelow . | |
| 256,600 | 4/1882 | Schell | 108/94 |
| 489,652 | 1/1893 | Lamb . | |
| 816,077 | 3/1906 | Crawford . | |
| 836,947 | 11/1906 | Shidler . | |
| 1,224,083 | 4/1917 | Drury . | |
| 2,229,171 | 3/1939 | Gritton . | |
| 3,003,648 | 10/1961 | LaVigne | 211/144 |
| 3,433,364 | 3/1969 | Chen | 211/144 X |
| 3,858,529 | 1/1975 | Salladay | 211/163 X |
| 3,998,334 | 12/1976 | Smith | 211/163 X |
| 4,426,010 | 1/1984 | LeMer | 211/144 X |
| 4,438,853 | 3/1984 | Numbers . | |

FOREIGN PATENT DOCUMENTS

| | | | |
|---|---|---|---|
| 1483056 | 8/1977 | United Kingdom | 211/163 |

*Primary Examiner*—Peter A. Aschenbrenner
*Attorney, Agent, or Firm*—Morrison & Foerster

[57] ABSTRACT

A rotating shelf is provided for the housing of books and magazines which is attractive, sturdy, and stores books and magazines efficiently. The shelf is characterized by L-shaped vertical supports between the shelf units which permit efficient storage and provide strength. Manufacturing methods employed in constructing the bookcase can also be used to construct storage racks for other items, such as wine bottles.

20 Claims, 3 Drawing Sheets

REVOLVING BOOKCASE

TECHNICAL FIELD

The invention relates to furniture useful for storage of books and magazines, wine bottles, or other items. More particularly, it concerns a rotating shelf unit which provides efficient storage and strength.

BACKGROUND ART

The general concept of convenient utilization of space for storing various items by using rotating mechanisms to provide maximum access is known. Very early U.S. Pat. Nos. 18,042; 111,608; 256,600; 489,652; 816,077; 836,947; and 1,224,083 describe various designs for rotating storage racks including bookcases and flower stands. U.S. Pat. No. 2,229,171 describes a rotating shelf which employs a tapered spindle having roller bearings to provide the desired rotation. U.S. Pat. No. 4,483,853 describes a rotating rack for baby food containers which rotates on rollers.

In addition, a number of rotating bookcases are on the market. These bookcases, generally, are either inefficient in their use of space by virtue of consuming shelf space to provide vertical support or fail to provide adequate vertical strength. The present invention overcomes these problems by an effective combination of a "bookend" function and a vertical support and vertical spacing function.

DISCLOSURE OF THE INVENTION

The invention provides a rotating shelf unit which efficiently stores books and magazines, which supports a large amount of unevenly distributed weight, and which is an attractive piece of furniture. The bookshelf is approximately square, may have one or a multiplicity of tiers, and utilizes the vertical support members as bookends so that the linear shelf space and shelf area are maximized.

Accordingly, in one aspect, the invention is directed to a rotating shelf unit for housing books and/or magazines which comprises at least two shelf panels separated by vertical supports. The vertical supports (or standoffs) are arranged in an "L" shape with the side of the L running just inside the edge of the shelf panel from one corner to an "interior" point approximately one-third, but less than halfway along the edge, and the base of the L extending inward from this point to a second point about one-sixth, but less than one-quarter of the distance across the unit. There are four such Ls configured on each tier of the rack. The four angles provide both bookend spacing and vertical support for the shelf units. By virtue of the arrangement, there is little or no wasted space on the surface of the shelf units, and books and magazines can conveniently be fitted in four groups around the shelf units on each tier. The assembly is mounted on a base which allows the rack to rotate freely on the base. The base can be supplied with casters and/or glides. Further, the top of the unit can be supplied with a cover panel for aesthetic reasons, including masking the cavities which contain the tenons.

In another aspect, the invention is directed to a method to manufacture the storage units for various materials using shouldered dowels as vertical supports, including bookcases, wine racks, storage racks for shirts and sweaters and the like. Shelf panels are linked and supported by insertion of tenons extended from the dowels into cavities provided in a preset pattern on the shelf panels.

MODES OF CARRYING OUT THE INVENTION

The rotating racks of the invention are particularly useful in the storage of books and magazines, as the arrangement of vertical supports permits optimizing the space provided by the shelf panels for such storage, but nevertheless maintains a high degree of strength, thus permitting the support of unevenly-distributed heavy books and papers. In a preferred embodiment, the L-shaped arrangement of vertical supports is provided by dowels which have been machined to include square-shouldered tenons at their ends for insertion into cavities provided in the shelf panels. Utilization of this approach not only permits efficient manufacture of the racks, but also provides a high degree of stability even without use of adhesives or other additional securing means.

Thus, the invention, a revolving tiered bookcase, provides a sturdy rotating unit of tiered panels that efficiently stores books and magazines. This unit, as a general assembly, is composed of the following: a bookcase assembly, which can have one or two or several tiers; a cornice panel; a skirt; and a disc and bearing assembly. The cornice panel and the skirt, respectively, attach to the top and bottom panels of the fully assembled bookcase assembly. The bookcase assembly with its foregoing, respective attachments then attaches to the bearing of the disc and bearing assembly, thereby completing the general assembly. The completed unit now floor mounts on casters or adjustable glides attached to the bottom of the disc and bearing assembly. See FIGS. 1, 2 and 3.

The construction of the bookcase assembly, the unit's major subassembly, can be modular and consists of multiple combinations of two distinct parts, a standard, e.g., (1" dia.×11½" lg. cylindrical) standoff and a standard, e.g., (20¼"×20¼"×¾" square) perforated panel. The standoff is square-shouldered with identical square-shouldered tenons on each end. See FIG. 3. Its combined function is that of bookend, panel spacer, and load-bearing member. The perforated panels define the horizontal organization of the tiered bookshelves by means of their identical patterns of drilled holes into which the standoff tenons are press-fitted and glued. For the bookcase assembly:

if (T)=(the number of tiers), where T=1 or 2 or several, and (P)=(the number of perforated panels), and (S)=(the number of standoffs or vertical supports), then (P)=(T+1) and (S)=(16)×(T).

Hence, a typical 3-tiered bookcase assembly will have P=(3+1)=4 perforated panels and S=(16)×(3)=48 standoffs. These parts will be assembled into two identical modules, each consisting of 2 perforated panels and 16 standoffs. The two modules will then be joined into a tiered assembly by utilizing the remaining 16 standoffs, thereby producing a 3-tiered bookcase assembly.

Figure 1:
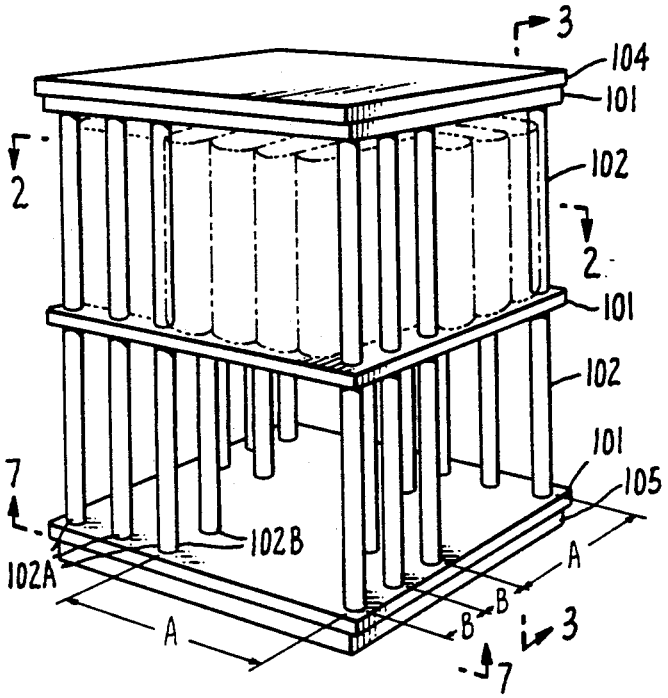
FIG. 1 shows a perspective view of the rotating rack of the invention.
Figure 2:
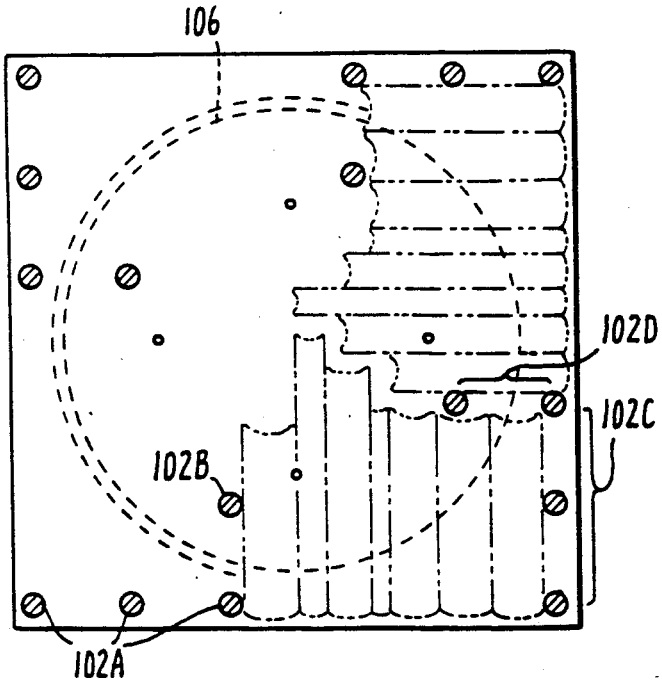
FIG. 2 shows a view along the line 2—2 of FIG. 1 looking downward from the top of the rack.

The internal organization of a typical module consists of 4 sets of fixed bookends (2 standoffs per bookend, 2 bookends per set) arrayed in a basketweave pattern about the periphery of the module's perforated panels (see FIGS. 1 and 2). These 1-6 standoffs are centered on the corners of four A×B rectangles which are uniformly nested in the panel corners and at a fixed distance in from the panel edges. This layout coincidentally results in an L-shaped clustering of 4 standoffs, that is, 2 bookends (1 each from adjoining bookend sets) near each corner, thereby enhancing the strength and stability of the structure.

This bookcase was designed for ease of assembly and for its component parts to be compatible with the most current automatic woodworking equipment. These principles can be applied to other storage racks as well. The simple and redundant geometry of the variously tiered bookcase assembly structures, which can be adapted to storage of other items as desired, dictates that their assemblies will be self-aligning and self-spacing when they are fitted and clamped and that they will remain so if they are properly glued. The precision, the repeatability and the efficiency of the most appropriate contemporary wood fabricating technology makes this unit, with its several attachments, a sturdy, reliable structure that is both practical and feasible. The versatility of the unit's design and the versatility of its manufacturing process can be made easily manifest. Given the same hardware and standoffs and blank panels, a mere substitution of panel drilling programs can produce a revolving tiered wine rack (FIG. 4) in lieu of a revolving tiered bookcase, a different product for an entirely different market. This example is offered to suggest the novelty, the potential, and the scope of the design and manufacturing approach taken in the foregoing cases.

Referring to FIG. 1, a two-tiered form of the invention book rack is shown. Three shelf panels 101 are shown, along with vertical support members 102, of which there are four groups of four between each pair of shelf panels. As shown in FIG. 1, each group of four supports forms an L-shaped unit 103 wherein the three supports designated 102A form the side of the L and the two supports 102B, one of which is shared with 102A, form the base of the L. As shown, the base of the L in one corner along with the side of the L in an adjacent corner provide a pair of bookends. As further shown in the figure, books are arranged around the spaces on the shelf. However, the dimensions of the spacing are such that magazines, lying flat, conveniently fit as well. As shown in FIG. 1, the top of the rack is finished by a cover panel 104 which extends slightly beyond the shelf panel at the top and the base is obscured by a skirt 105 which is recessed from the bottom shelf panel. The shelf panels, supports, and cover panels and skirt can be made of any convenient material, but lumber is preferred for ease of machining and for aesthetic appeal. There is no theoretical reason why, for example, plastic or metal could not be used as well, but these materials may be more difficult to adapt to the method of the invention and are certainly less conventional in construction of furniture of this type.

FIG. 2 shows a face-on view from the top of the unit. This figure clearly shows the L-shaped arrangement of the vertical supports. As seen in FIG. 2, the supports 102A are just inside the edge of the shelf panel extending from the corner to an "interior" point less than half the distance along the edge. The pair of supports 102B form the base of the L which extends inward from the edge (so as to form one bookend of a bookend set) to a point approximately one-sixth, but less than one-quarter of the distance across the panel. The other bookend of the set is formed mainly by about ⅔ of the side (102C) of L which occupies the other corner of the same edge. The base (102D) of this L provides one end of a bookend set on the adjacent edge. Thus, a total of 4 sets of bookend/vertical support sets comprising, in this case, 16 dowels, are distributed in a symmetric pattern on each shelf panel.

FIG. 2 further shows the location of the base 106 which is secured to the unit through a turntable so as to provide free rotation of the unit about the base. This rotation means may be any conventional bearing system; such rotating attachment means are commercially available at retail hardware stores or at lumber yards. Such units provide attachment points for engaging both the bottom shelf panel of the unit to be rotated and the base.

Figure 3:
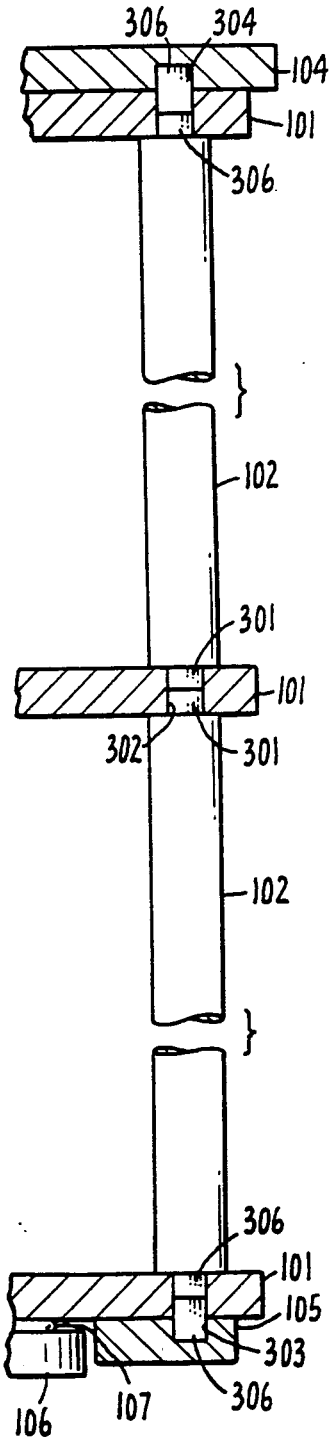
FIG. 3 is a view along the line 3—3 of FIG. 1 showing the integration of the support means.

FIG. 3 shows the means for attachment of the vertical members to the shelf panels. FIG. 3 also shows a section of the base 106 which is connected through a rotating attachment means, a portion of which is shown as 107, to the bottom panel 101. Also shown in FIG. 3 is a skirt 105 which conceals the base when the unit is viewed from above.

As shown in FIG. 3, the support units 102 are extended by tenons 301 which are conveniently formed by machining a cylindrical dowel 102 to provide a square-shouldered tenon. The length of the tenon extension is such that it is equal to approximately one-third but less than one-half the thickness of the shelf panel as shown. Thus, the support 102 is engaged in the panel 101 by means of insertion into a cavity 302 which has been drilled through the panel. The cavity is almost filled by the combination of the tenons from the upper and lower support members. Similarly, the skirt and cover panels are secured by pegged insertions or smaller dowels 306 utilizing cavities of the same dimension shown as 303 and 304 respectively.

Thus, it can be seen that the unit can be manufactured in an extremely simple way by standardizing the arrangement of the supports and the method of their attachment. The shelf panels are uniformly provided with 16 holes drilled through the thickness of the panels arranged as shown in FIG. 2. Vertical supports are provided with square-shouldered tenons of a diameter to fit the drilled cavities in the panels. All vertical supports are identical. The weight-carrying portions of the unit are then assembled by inserting the vertical supports into the bottom panel, laying on the next panel so that the opposite ends of the supports are inserted into the correspondingly drilled cavities of the next panel, and adding supports and panels alternately for the desired number of tiers. The top shelf panel is then covered with a cover panel, if desired, which can be secured to the top shelf panel by 4 short dowels of the dimensions suitable for the cavity as shown in FIG. 3. Thus, the cover panel is drilled in a manner similar to that for the shelf panels except that the 4 cavities extend only part way through the thickness of the top panel. The corner hole pattern is identical to that of the perforated panel.

The inserted tenons and dowels are preferably held in place using an adhesive; however because of the construction design, the structure is extremely stable even without the use of adhesive.

The skirt is attached in a manner analogous to that used for the cover panel as shown in FIG. 3. The skirt has four cavities 303, one at each corner to receive the pegs (dowels) 306. The skirt can conveniently be manufactured by removing from a square panel, slightly smaller than the bottom shelf panel, a circular disk which provides the base 106 and using the remainder of the square panel as the skirt 105.

Figure 6:
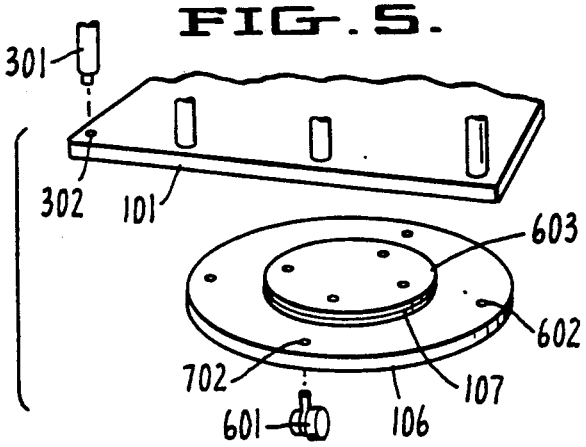
FIG. 6 shows details of the attachment of rotating base and vertical support members.

The bottom panel 101 is then attached to the base through the rotating attachment means or turntable. The rotating attachment means is first secured to the base using the attachments provided by the manufacturer and the rotating attachment means is then attached in turn to the bottom shelf panel. The base may further be provided with casters, glides or other supporting members as shown in FIG. 6.

Figure 7:
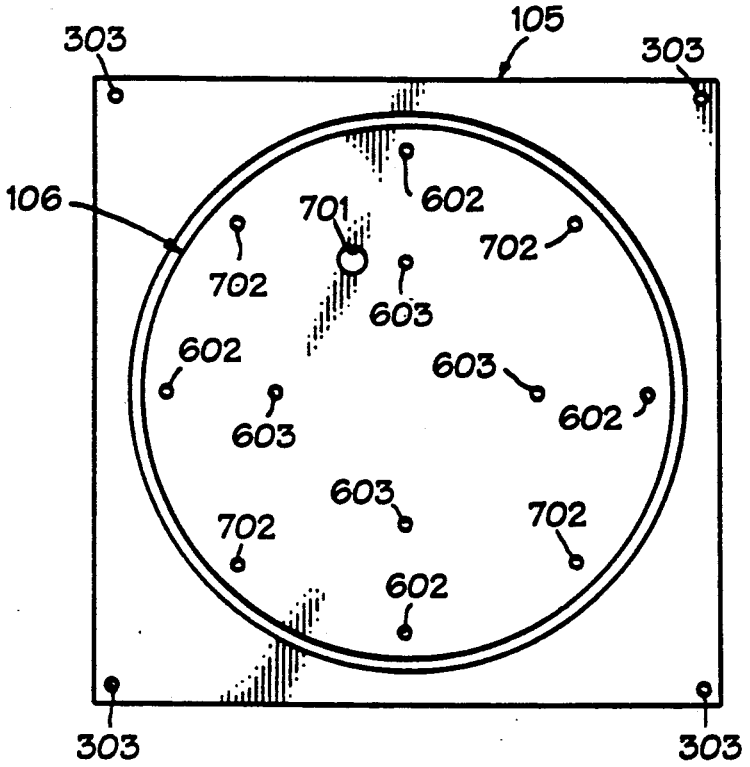
FIG. 7 shows details of one embodiment of the attachment of the rotating unit to the base.

This is shown in more detail in FIG. 7, which is a view from the top of the base before attachment to the underside of the bookcase or to the turntable. The skirt 105 is secured to the bottom shelf panel 101 through the pegs or dowels; the outline of the position of the cavities (303) in the skirt are shown.

Inside the skirt is the base 106 which has been cut from the same panel as the skirt. The attachment of the skirt 105 to the bottom panel 101 is further secured by glue and the surfaces of the bottom of the bottom shelf panel and the top of the skirt thus remain unfinished.

The base 106 is attached to the turntable/rotating attachment means by four screws 603. After attachment of the rotating attachment means to the base, the assembly is secured to the bottom shelf panel by means of four additional screws which are inserted through the access hole 701 drilled into the base. The position of the access hole is determined by the design of the turntable used. The base is also provided with cavities 602 and 702 to accommodate adjustable glides and/or casters.

Convenient dimensions for an illustrative embodiment of the units of the invention include 20¼ inch panels supported by dowels of 1-inch diameter having 11½ and 10½ inch lengths, depending on the size of books desired to be accommodated. For these dimensions, approximately 11 feet of linear bookspace is provided by a three-tiered unit. A three-tiered unit can readily support several hundred pounds of weight.

In this illustrative embodiment, the panels are conveniently approximately ¾ inch thick, and the tenons at the ends of the dowels are thus 5/16 inch long. They are conveniently ⅜ inch in diameter, and the ⅜ inch diameters of the holes drilled in the shelf panels are thus designed to accommodate this thickness.

In the illustrative design shown, the cover panel extends approximately ¼ inch over the top panel on each side; the skirt is recessed by ¼ inch.

Of course it is not necessary to utilize dowels in the construction, although this makes for an extremely convenient manufacturing process. One could also use, to form the L-shaped bookends, angle irons, bricks, and the like.

Figure 4:
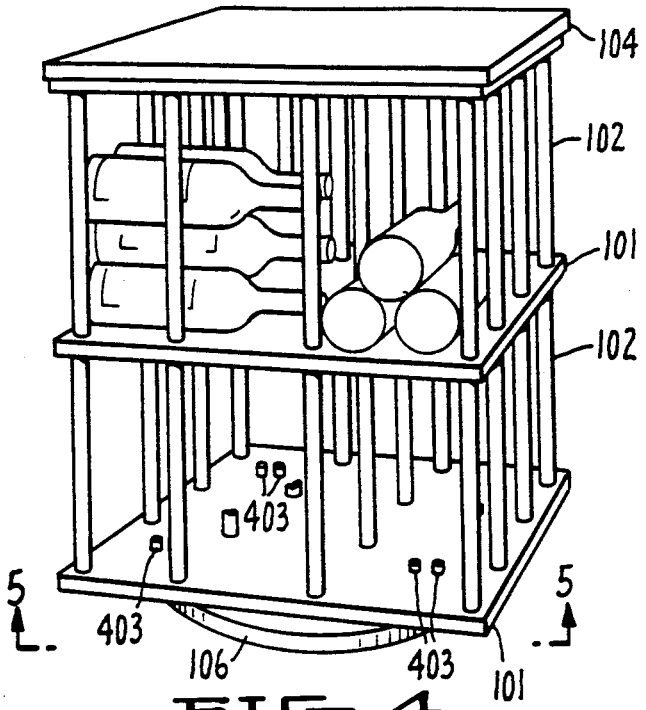
FIG. 4 shows an alternate design constructed by the method of the invention adapted to the storage of wine bottles.

FIG. 4 shows an adaptation of the manufacturing method of the invention to construction of a rotating wine rack. As shown in FIG. 4, the arrangement of the dowels 102 along the shelf panels 101 is redesigned so as to accommodate an arrangement of horizontally-stacked wine bottles. Although the arrangement of supports is different, the advantages of strength and ease of construction are retained. The design shown in FIG. 4 also utilizes sixteen vertical supports or standoffs but in a different arrangement designed to accommodate the intended use. As shown, storage is provided for at least four sets of six bottles lying flat per shelf as shown. The bottles are supported laterally by two vertical supports on either side. For example, as shown in Figure 4, the four supports shown as 402 support the bottles shown at the right of the figure. In addition, two pegs (dowels) prevent slippage when only one bottle remains in the segment of the unit provided.

Figure 8:
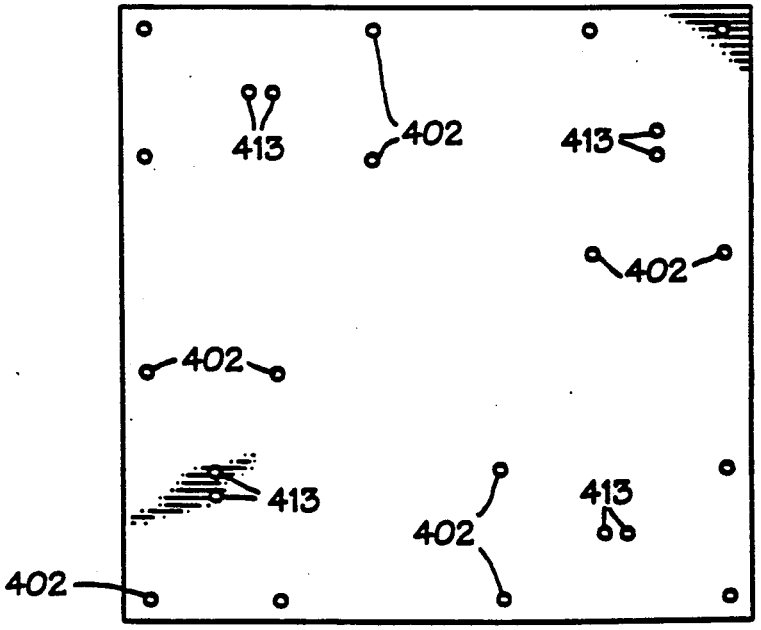
FIG. 8 shows a bottom view of the layout of the vertical standoffs and pegs of the wine rack shown in FIG. 4.

FIG. 8 shows a diagram of the panel hole layout for the dowels in a single tier of the wine rack shown in FIG. 4. It also shows the far side locations of the blind holes 403 (⅜" deep) that accommodate the ⅜"×¾" long bottle retaining dowels (not shown in FIG. 4).

Figure 5:
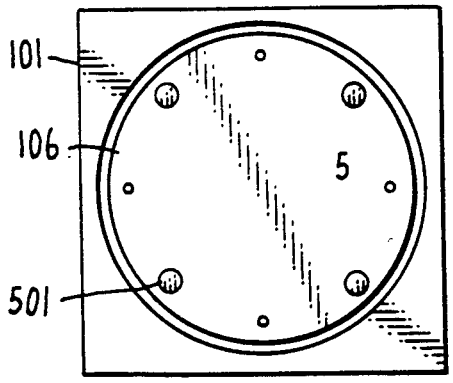
FIG. 5 shows a base view along the line 5—5 of FIG. 4.

FIG. 5 shows a bottom view of the wine rack of FIG. 4 along the line 5—5. This is identical with the base of the bookcase of Figure 1, except for the absence of a skirt surrounding the base. As more clearly shown in FIG. 5, the base 106 is attached to the bottom shelf panel 101 through a rotating attachment means. The base includes glides which permit the unit to seat comfortably on a floor surface.

FIG. 6 shows the rotating attachment means 107 secured to the base 106 which is in this example provided with rollers 601. The insertion of the tenons 301 into the cavities 302 in the bottom shelf panel 101 is also shown. This embodiment does not include a skirt.

The design of the revolving, tiered bookcase is made practical and feasible by the rapid and precise between-centers hole drilling capability of the (automatic) CNC machine on which its various panels can be drilled. This repeatable (programmed) capability reliably insures the precise positioning and coincidental and coaxial alignment of the respective major axes of each of the 16 sets of (1, 2, 3 or 4) press-fitted cylindrical standoffs and the 8 dowels which, in combination with the standoffs, connect and space the shelves and panels of the bookcase. (The major axis of each square-shoulder cylindrical standoff and the major axis of each of its two square-shoulder cylindrical tenons are also fabricated to be coincidental). The foregoing relationships are strong advantages of the design and structure of this bookcase (and its manufacturing process) and serve to constrain the assembly (when it is glued and clamped) into a strong self-aligning and self-spacing integral structure whose shelves and panels are virtually parallel.

Importantly, the same approach is useful in the construction of storage units wherein the spacing of the standoffs or vertical support members is designed to accommodate the desired item. Thus, as set forth above, this approach is equally advantageous in the construction of the wine rack shown in FIGS. 4-6 or in storage units intended for other items such as sweaters or shirts, jars, cans, storage bins, or other packaged units.

In all such designs, the preferred embodiment employs a set of 16 support members or standoffs which consists of 4 subsets. The members of each subset are arrayed in a coaxial pattern about the center axis of the revolving (rotating) storage unit so that as the unit is rotated, all four members traverse the same orbit. As used herein, "coaxial" refers to positions equidistant from a common axis. Thus, the support members provide 4 arrays of coaxially spaced supports which stabilize the rotation by virtue of this symmetry. In alternative designs, the number of subsets and the number of members of each subset can be varied according to use, but in all cases, members of each subset are coaxial as above defined.

In the general case, the support members comprise $n_1$ subunits each containing $n_2$ members wherein each $n_2$ can be independently chosen. Typical values of $n_1$ and each $n_2$ are 2-6.

I claim:

1. A rotating storage unit for books and/or magazines comprising:

at least two shelf panels;

a plurality of vertical support members;

a base member which is secured to the bottom of one of said shelf panels in a freely rotating manner, wherein said shelf panels are generally square planar members having four corners and four edges of approximately equal length, and wherein said vertical support members are arranged as an "L" at each corner of the shelf panels with the side of each L parallel to and proximal to one edge of the shelf unit and extending to a point on said edge less than halfway the length of the edge, and the base of said L extending inward from said edge at said point;

said vertical support members being spaced so that the base of the L at a first corner along with the side of an L at a second, adjacent corner form a pair of bookends.

2. The rotating unit of claim 1 which further comprises a cover panel.

3. The rotating unit of claim 1 which further comprises a bottom skirt panel.

4. The rotating unit of claim 1 wherein said vertical supports are cylindrical dowels, and wherein the side of the L comprises three such dowels and the base of said L is one of these plus an additional dowel.

5. The rotating unit of claim 4 wherein said dowels are secured to the shelf panels by tenons extending from the end of the dowels.

6. The rotating unit of claim 5 wherein said tenon engages said shelf panel by extending less than half way through the thickness of the shelf panel in a cavity of approximately the same diameter as the tenon.

7. The rotating unit of claim 6 wherein said tenon is secured to the cavity with an adhesive.

8. The rotating unit of claim 2 wherein the cover panel is secured to the top shelf panel by four dowels extending approximately halfway through a cavity of the same diameter in said top shelf panel.

9. The rotating unit of claim 3 wherein the skirt is secured to the bottom shelf panel by four dowels extending approximately halfway through a cavity of the same diameter in said bottom shelf panel.

10. The rotating unit of claim 1 which further comprises casters or glides attached to said base.

11. The rotating unit of claim 1 wherein the base is secured to the bottom shelf panel through a rotating attachment means contained within the base.

12. The rotating unit of claim 1 which comprises at least three shelf panels.

13. The rotating unit of claim 1 which comprises at least four shelf panels.

14. The rotating unit of claim 1 which comprises at least five shelf panels.

15. A method to manufacture a storage unit, which storage unit comprises at least two shelf panels and a plurality of vertical support members; which method comprises providing as said vertical support members dowels of identical length and thickness and containing square-shouldered tenons of such length as to extend almost one-half way through the thickness of the shelf panels;

providing cavities in the shelf panels in a pattern of four L-shaped subpatterns at the four corners of the shelf panels, oriented with the side of the L along the edge of the panel and the base extending inward from an interior point along the edge, and of such dimensions as to accommodate the tenons of the vertical support members;

inserting the tenons of the vertical support members into the cavities of a first shelf panel; and inserting the tenons at the opposite ends of the vertical support members into the cavities of the second shelf panel.

16. The method of claim 15 further includes providing adhesive between the tenons and the cavities.

17. The method of claim 15 wherein the unit comprises at least three shelf panels and the pattern is identical in all shelf panels.

18. The method of claim 15 which further includes securing the bottom of said storage unit to a base through a rotating attachment means.

19. A method for manufacturing a storage unit, which storage unit comprises at least two shelf panels and a plurality of vertical support members, which method comprises;

providing said at least two shelf panels including a top shelf panel and at least one storage shelf panel;

providing for each storage shelf panel as said vertical support members a set of dowels of identical length and thickness and containing square-shouldered tenons of such length as to extend almost one-half way through the thickness of said shelf panels;

providing cavities in said shelf panels in a pattern of four L-shaped subpatterns at the four corners of the shelf panels, oriented with the side of the L along the edge of the panel and the base extending inward from an interior point along the edge, and of such dimensions as to accommodate the tenons of the vertical support members;

inserting the tensions of the vertical support members into said cavities of said storage shelf panel;

inserting the tenons at the opposite ends of said vertical support members into the cavities of a next higher shelf panel; and repeating said steps of inserting tenons until said next higher shelf panel is said top shelf panel.

20. A method for manufacturing a storage unit, which storage unit comprises at least two shelf panels and a plurality of vertical support members, which method comprises;

providing said at least two shelf panels including a first shelf panel and a second shelf panel;

providing for each storage shelf panel as said vertical support members a set of dowels of identical length and thickness and containing square-shouldered tenons of such length as to extend almost one-half way through the thickness of said shelf panels;

providing cavities in said shelf panels in a pattern of four L-shaped subpatterns at the four corners of the shelf panels, oriented with the side of the L along the edge of the panel and the base extending inward from an interior point along the edge, and of such dimensions as to accommodate the tenons of the vertical support members;

a first step of inserting the tenons of the vertical support members into said cavities of said first shelf panel;

a second step of inserting the tenons at the opposite ends of said vertical support members into the cavities of said second shelf panel; and repeating said steps of inserting tensions whereby the second shelf panel of the preceding second step of inserting becomes the first shelf panel of the succeeding first step of inserting and wherein another shelf panel becomes said second shelf panel in the succeeding second step of inserting until all of said shelf panels have been installed.

* * * * *

UNITED STATES PATENT AND TRADEMARK OFFICE

CERTIFICATE OF CORRECTION

PATENT NO. : 5,101,738

DATED : 7 April 1992

INVENTOR(S) : Xen N. Sideris

It is certified that error appears in the above-identified patent and that said Letters Patent is hereby corrected as shown below:

Column 2, line 21: "bottom" should read --top--;

Column 3, line 18: "1-6" should read --16--;

Column 6, line 24: cancel "far side";

Column 6, line 25: "403" should read --413--;

Column 6, line 26: cancel "not";

Column 6, line 46 and 47: "16 sets of (1, 2, 3 or 4)" should read --(1, 2, 3 or 4) sets of 16--.

Signed and Sealed this

Sixth Day of July, 1993

Michael K. Kirk

*Attest:*

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,101,738

DATED : 7 April 1992

INVENTOR(S) : Xen N. Sideris

It is certified that error appears in the above-identified patent and that said Letters Patent is hereby corrected as shown below:

In Figure 2, reference number 102B should refer to two item:

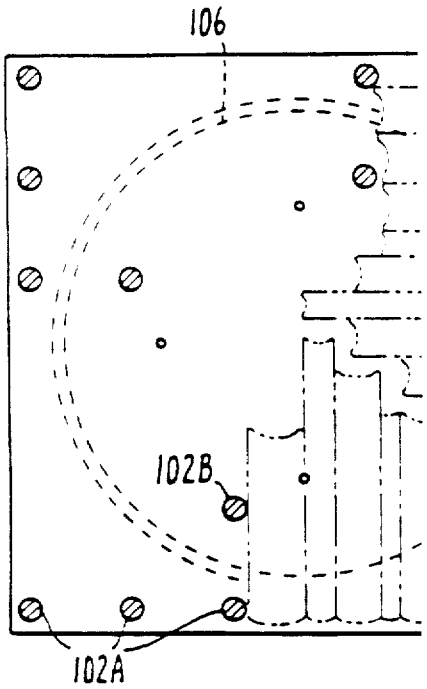

FIG. 2. (PART)
IS

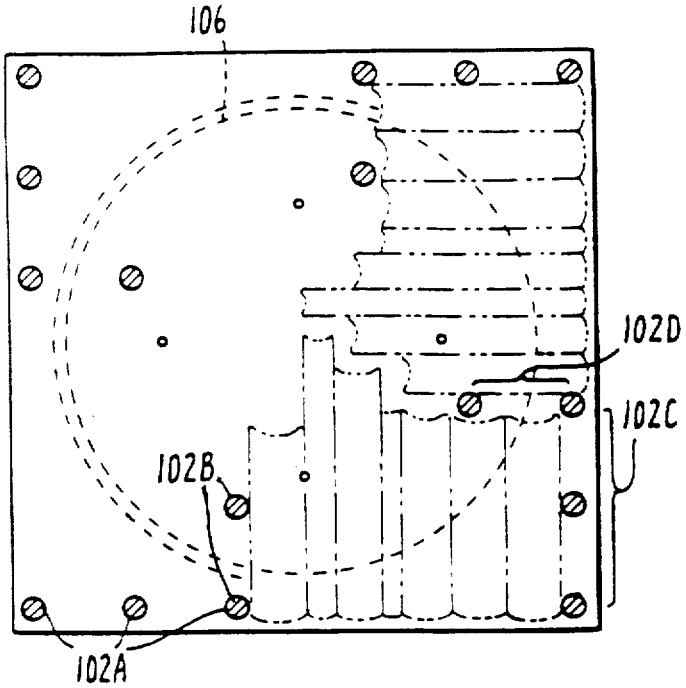

FIG. 2.
SHOULD BE

UNITED STATES PATENT AND TRADEMARK OFFICE
CERTIFICATE OF CORRECTION

PATENT NO. : 5,101,738

DATED : April 7, 1992

INVENTOR(S) : Xen N. Sideris

It is certified that error appears in the above-identified patent and that said Letters Patent is hereby corrected as shown below:

In the Figures:

In Figure 5, delete the outer one of the two large circles.

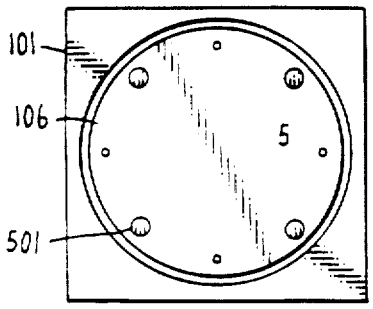

FIG. 5.
IS

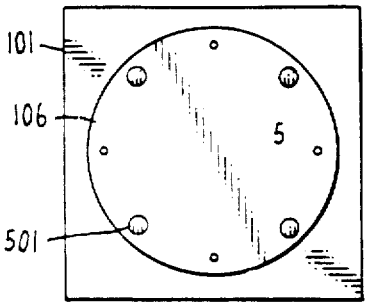

FIG. 5.
SHOULD BE